US010871740B2

(12) United States Patent
Fukusaka

(10) Patent No.: US 10,871,740 B2
(45) Date of Patent: Dec. 22, 2020

(54) IMAGE FORMING APPARATUS WITH AN ELECTRICAL WIRE BUNDLE HAVING A BRANCHING AND WINDING ELECTRICAL WIRE

(71) Applicant: CANON KABUSHIKI KAISHA, Tokyo (JP)

(72) Inventor: Tetsuro Fukusaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/914,279

(22) Filed: Mar. 7, 2018

(65) Prior Publication Data

US 2018/0268957 A1 Sep. 20, 2018

(30) Foreign Application Priority Data

Mar. 17, 2017 (JP) ..... 2017-052268

(51) Int. Cl.

| | |
|---|---|
| ***G03G 15/00*** | (2006.01) |
| ***G03G 15/16*** | (2006.01) |
| ***H01B 7/00*** | (2006.01) |
| ***H01B 9/00*** | (2006.01) |

(52) U.S. Cl.

CPC ..... *G03G 15/80* (2013.01); *G03G 15/1605* (2013.01); *G03G 15/5054* (2013.01); *G03G 15/5058* (2013.01); *H01B 7/0045* (2013.01); *H01B 9/003* (2013.01); *G03G 2215/1623* (2013.01)

(58) Field of Classification Search

CPC ..... H01B 7/0045; H01B 7/009; G03G 15/80
USPC ..... 174/71 C, 71 R; 439/623, 624
See application file for complete search history.

(56) References Cited

U.S. PATENT DOCUMENTS 286,963 A * 10/1883 Reed ..... H01R 31/06 439/623
2,276,902 A * 3/1942 Webber ..... H01B 7/04 174/105 R
9,354,592 B2 * 5/2016 Kakutani ..... G03G 21/1604

FOREIGN PATENT DOCUMENTS

JP H10-248143 A 9/1998

* cited by examiner

*Primary Examiner* — Arlene Heredia
(74) *Attorney, Agent, or Firm* — Venable LLP

(57) ABSTRACT

An electric wire bundle in which a plurality of electric wires are bundled without using a wire bundling tool is provided. The electric wire bundle, formed by bundling a plurality of the electric wires, connects devices. The electric wire connecting two devices positioned farthest from each other is wound by the other electric wire. Other electric wires branch in order at branch points provided between the two devices positioned farthest from each other and are connected to a corresponding device.

5 Claims, 5 Drawing Sheets

IMAGE FORMING APPARATUS WITH AN ELECTRICAL WIRE BUNDLE HAVING A BRANCHING AND WINDING ELECTRICAL WIRE

BACKGROUND OF THE INVENTION

Field of the Invention

The present disclosure relates to a bundle of a plurality of electric wires applicable to wiring inside an electric apparatus such as an image forming apparatus.

Description of the Related Art

An apparatus such as an image forming apparatus comprises components such as various circuits arranged in a housing to realize functions of the apparatus. The components are connected by a plurality of electric wires. To prevent damage and a burnout caused by a contact with the components and to prevent the electric wires from being loosened in the apparatus, the electric wires are bundled. A bundle of the plurality of the electric wires is referred to as an electric wire bundle. The plurality of the electric wires are often bundled using a wire bundling tool such as a spiral tube. Japanese Patent Application Laid-Open No. 10-248143 discloses a technology in which, using a curled code which is processed to keep a spiral shape as the wire bundling tool, the plurality of the electric wires are drawn in the curled code to bundle the wires.

As mentioned, conventionally, the plurality of the electric wires are bundled using the wire bundling tool such as the curled code. Use of the wire bundling tool results in a rise in cost. Thereby, a technique to bundle the plurality of the electric wires without using the wire bundling tool is required.

SUMMARY OF THE INVENTION

An electric wire bundle according to the present invention includes a plurality of electric wires, wherein the plurality of the electric wires comprise: a first electric wire configured to connect a first connector and a second connector; and second electric wire configured to branch from the electric wire bundle at a branch point provided between the first connector and the second connector to connect the first connector and a third connector, and wherein the first electric wire is wound by the second electric wire from the first connector to the branch point.

Further features of the present invention will become apparent from the following description of exemplary embodiments (with reference to the attached drawings).

DESCRIPTION OF THE EMBODIMENTS

In the following, embodiments are described in detail with reference to the accompanying drawings.

Figure 1:
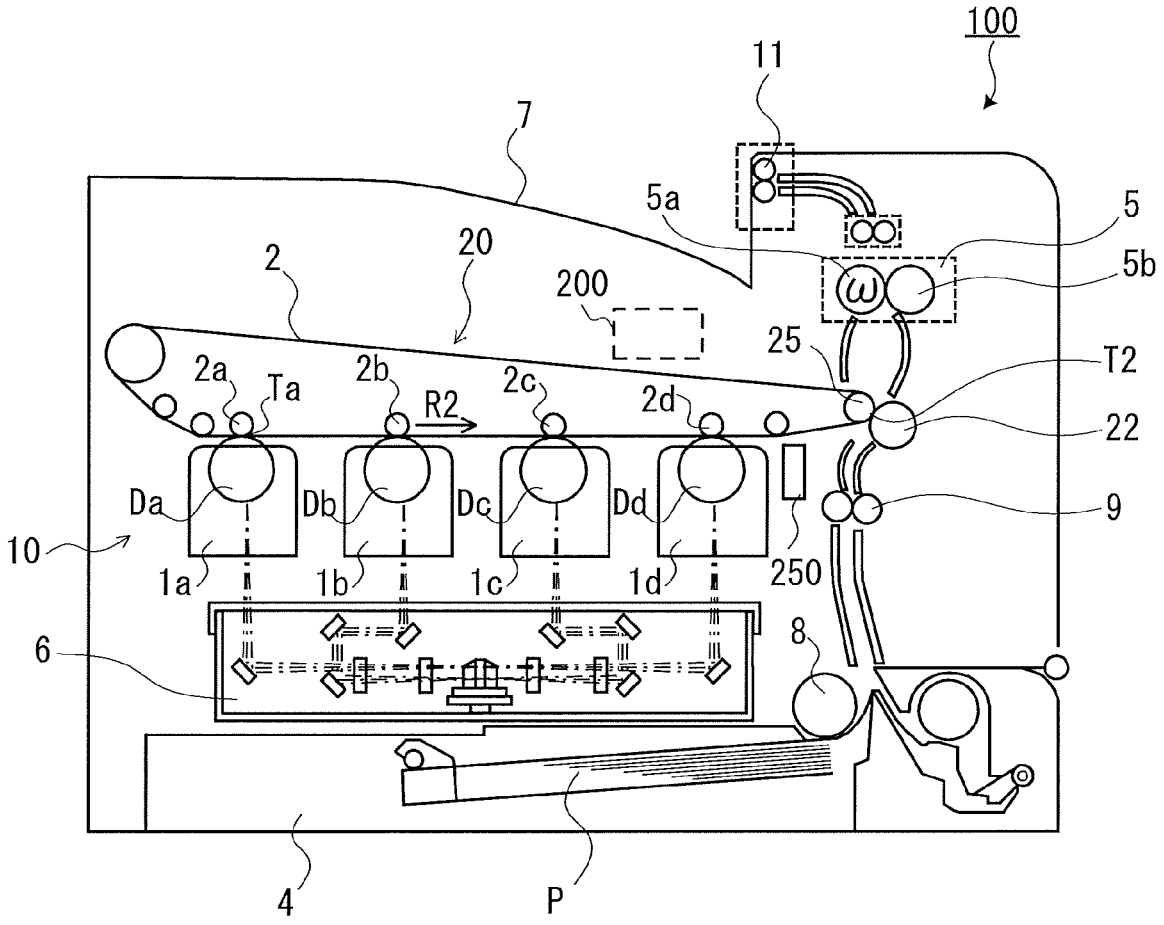
FIG. 1 is a configuration diagram of an image forming apparatus.

FIG. 1 is a configuration diagram of an image forming apparatus in which the electric wire bundle of the present embodiment is used. An image forming apparatus 100 is a full color printer of a tandem type intermediate transfer system. The image forming apparatus 100 comprises image forming parts 1*a*, 1*b*, 1*c*, and 1*d* for forming a toner image and an intermediate transfer unit 20. The image forming apparatus 100 comprises a paper feeding cassette 4 for storing a recording material P such as a paper on which an image is formed, an exposure device 6, a fixing device 5, and a conveyance path for conveying the recording material P.

The image forming parts 1*a*, 1*b*, 1*c* and 1*d* are exchangeable units comprising photosensitive drums Da, Db, Dc and Dd as image carriers. Each of the image forming parts 1*a*, 1*b*, 1*c*, and 1*d* corresponds to a different color. In each of the photosensitive drums Da, Db, Dc, and Dd, a toner image of a corresponding color is formed. For example, in the photosensitive drum Da, the toner image of yellow is formed. In the photosensitive drum Db, the toner image of magenta is formed. In the photosensitive drum Dc, the toner image of cyan is formed. In the photosensitive drum Dd, the toner image of black is formed. Each of the image forming parts 1*a*, 1*b*, 1*c*, and 1*d* has the same configuration. In the following, the configuration of the image forming part 1*a* is described and the description with regard to the configuration of the rest of the image forming parts 1*b*, 1*c*, and 1*d* is omitted.

In addition to the photosensitive drum Da, the image forming part 1*a* comprises a charging roller and a developing device (not shown). The photosensitive drum Da is an aluminum cylinder. A photosensitive layer is formed on an outer peripheral surface of the photosensitive drum Da. The photosensitive drum Da is rotationally driven by a motor (not shown) at a predetermined process speed. The charging roller uniformly charges the photosensitive layer of the photosensitive drum Da to a potential of negative polarity. An electrostatic latent image is formed on the photosensitive layer of the photosensitive drum Da when the photosensitive layer is charged and irradiated with a laser beam by the exposure device 6. The developing device has a developer such as toner. The developing device adheres the developer to the electrostatic latent image formed on the photosensitive layer of the photosensitive drum Da to develop the electrostatic latent image to form the toner image.

The exposure device 6 scans each of the photosensitive drums Da, Db, Dc, and Dd by the laser beam modulated in accordance with the image data of a color corresponding to each of the image forming parts 1*a*, 1*b*, 1*c*, and 1*d*. The exposure unit 6 forms the electrostatic latent image of a color corresponding to each of the photosensitive drums Da, Db, Dc, and Dd by the scanning of the laser beam. For example, the exposure device 6 scans the photosensitive drum Da by the laser beam based on the image data of yellow to form the electrostatic latent image of yellow image on the photosensitive drum Da.

The intermediate transfer unit 20 is an exchangeable unit which is arranged above the image forming parts 1*a*, 1*b*, 1*c* and 1*d*. The intermediate transfer unit 20 comprises an intermediate transfer belt 2 and primary transfer rollers 2*a*, 2*b*, 2*c*, and 2*d*. The intermediate transfer belt 2 is an image carrier composed of an endless shape belt member with no elasticity. The toner image is transferred to the intermediate transfer belt 2 from the photosensitive drums Da, Db, Dc, and Dd. The intermediate transfer belt 2 is stretched across rollers such as a secondary transfer tension roller 25 and supported. The intermediate transfer belt 2 is driven by the rollers and rotates in an arrow R2 direction.

The primary transfer roller 2*a* is arranged at a position opposite to the photosensitive drum Da interposing the intermediate transfer belt 2 therebetween. A primary transfer part Ta is formed between the intermediate transfer belt 2, pressed to a photosensitive drum Da side by the primary transfer roller 2*a*, and the photosensitive drum Da. When a direct voltage of positive polarity is applied to the primary transfer roller 2*a*, the toner image of negative polarity formed on the photosensitive drum Da is transferred to the intermediate transfer belt 2 at the primary transfer part Ta. The primary transfer roller 2*b* is arranged at a position opposite to the photosensitive drum Db interposing the intermediate transfer belt 2 therebetween. The primary transfer roller 2*b* transfers the toner image formed on the photosensitive drum Db to the intermediate transfer belt 2. The primary transfer roller 2*c* is arranged at a position opposite to the photosensitive drum Dc interposing the intermediate transfer belt 2 therebetween. The primary transfer roller 2*c* transfers the toner image formed on the photosensitive drum Dc to the intermediate transfer belt 2. The primary transfer roller 2*d* is arranged at a position opposite to the photosensitive drum Dd interposing the intermediate transfer belt 2 therebetween. The primary transfer roller 2*d* transfers the toner image formed on the photosensitive drum Dd to the intermediate transfer belt 2. As mentioned, the toner image is superimposingly transferred from each of the photosensitive drums Da, Db, Dc, and Dd to the intermediate transfer belt 2 to form a full-color toner image. It is noted that a configuration combining the image forming parts 1*a*, 1*b*, 1*c* and 1*d*, the exposure device 6, and the intermediate transfer unit 20 is referred to as an image forming unit 10.

The recording material P stored in the paper feeding cassette 4 is conveyed to a secondary transfer part T2 formed by a secondary transfer roller 22 and the secondary transfer tension roller 25. A separation roller 8 and a registration roller 9 are provided on a conveyance path from the paper feeding cassette 4 to the secondary transfer part T2. The separation roller 8 separates the recording material P drawn out from the paper feeding cassette 4 one by one and conveys the recording material P to the registration roller 9. The registration roller 9 stops the conveyed recording material P to perform a skew correction and the like. The registration roller 9 conveys the stopped recording material P to the secondary transfer part T2 in accordance with timing when the toner image formed on the intermediate transfer belt 2 reaches the secondary transfer part T2.

The recording material P and the intermediate transfer belt 2 are sandwiched between the secondary transfer tension roller 25 and the secondary transfer roller 22 at the secondary transfer part T2. When the direct voltage of positive polarity is applied to the secondary transfer roller 22, a transfer electric field for the toner image is generated between the secondary transfer roller 22 and the secondary transfer tension roller 25 connected to a ground potential. Being sandwiched between the secondary transfer tension roller 25 and the secondary transfer roller 22 and with the generation of the transfer electric field therebetween, the toner image formed on the intermediate transfer belt 2 is transferred to the recording material P.

The fixing device 5 is provided on a downstream side of the conveyance path when viewed from the secondary transfer part T2. The fixing device 5 comprises a fixing roller 5*a* having a heater and a pressurizing roller 5*b*. The fixing roller 5*a* is brought into pressure contact with the pressurizing roller 5*b* to form a pressure nip. By being nipped and conveyed by the pressure nip, the toner image is thermally press-bonded on the recording material P. A discharge roller 11 is provided on a downstream side of the conveyance path when viewed from the fixing device 5. The discharge roller 11 discharges the recording medium P having the toner image fixed by the fixing device 5 to a delivery tray 7.

The image forming apparatus 100 comprises a registration patch sensor unit 250, arranged in parallel with the image forming part 1*d*, near the intermediate transfer belt 2. The registration patch sensor unit 250 comprises three registration patch sensors which read a test image formed on the intermediate transfer belt 2 for stable image formation. The three registration patch sensors are arranged in parallel in a direction which is orthogonal to a rotation direction of the intermediate transfer belt 2 (a depth direction in FIG. 1).

Operation of the image forming apparatus 100 as mentioned is controlled by a control unit 200 incorporated in the image forming apparatus 100. When an instruction to start image forming processing is received from an operation part provided in the image forming apparatus 100 or an external device or the like (not shown), the control unit 200 controls operation of each part of the image forming apparatus 100 to perform the image forming processing.

Figure 2:
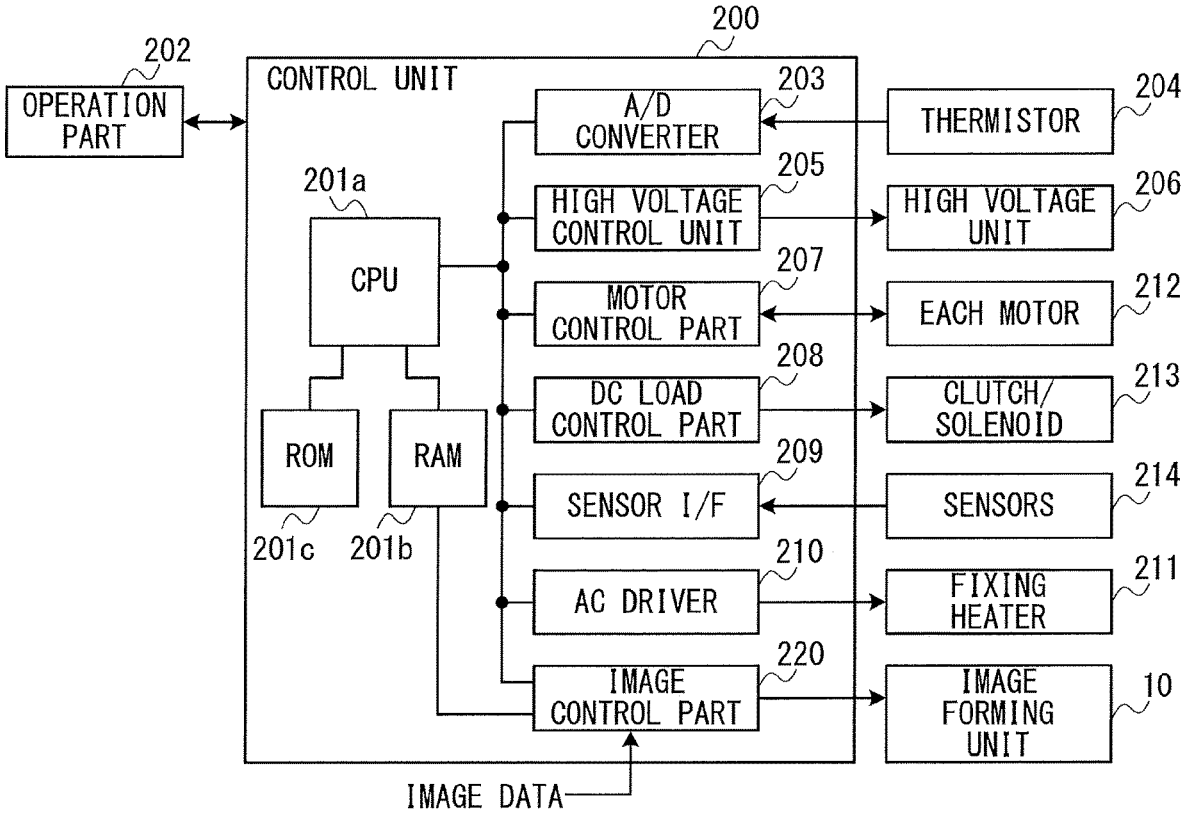
FIG. 2 is a block diagram of a control unit.

FIG. 2 is a block diagram of the control unit 200. The control unit 200 is connected to an operation part 202, a thermistor 204, a high voltage unit 206, each motor 212, a clutch/solenoid 213, sensors 214, a fixing heater 211, and the image forming unit 10. The high voltage unit 206, each motor 212, the clutch/solenoid 213, the fixing heater 211, and the image forming unit 10 are parts to be controlled which are controlled by the control unit 200. Each of the parts to be controlled has different functions. The control unit 200 transmits control signals in accordance with the function of the high voltage unit 206, each motor 212, the clutch/solenoid 213, the fixing heater 211, and the image forming unit 10 to control the operation of each part.

The operation part 202 is a user interface for inputting, through the operation of a user, the instruction to start the image forming processing and information including a paper type of the recording material P, a size of the recording material P, a copy magnification, and a density set value to the control unit 200. To input the instruction to the image forming apparatus 100, the operation part 202 may comprise a start button, a reset button, a numeric keypad, and a display or it may comprise a touch panel. A state of the image forming apparatus 100, for example, the number of image formed sheets, information whether the image is being formed or not, occurrence of jam and its part and the like, is displayed on the display by the control unit 200.

The thermistor 204 measures a temperature of the fixing roller 5*a* in the fixing device 5 and inputs the measurement result to the control unit 200. The high voltage unit 206 applies an appropriate high voltage to the charging roller, the primary transfer rollers 2*a*, 2*b*, 2*c*, and 2*d*, the secondary transfer roller 22, and a developing roller in the developer and the like. Each motor 212 drives each roller and a movable part in the image forming apparatus 100. To smoothly perform the image forming operation, the clutch/solenoid 213 controls the operation of each part. The sensors 214 detects a state of each part in the image forming apparatus 100 and inputs the detection result to the control unit 200. The sensors 214 includes, for example, a plurality of conveyance sensors for detecting a position of the recording material P, an opening/closing sensor for covers of the image forming apparatus 100, a position detection sensor for detecting whether a swinging unit is at a predetermined position, the registration patch sensor and the like. The fixing heater 211, incorporated in the fixing roller 5*a*, heats the fixing roller 5*a*.

The control unit 200 is a computer comprising a CPU (Central Processing Unit) 201*a*, a RAM (Random Access Memory) 201*b*, and a ROM (Read Only Memory) 201*c*. The CPU 201*a* controls the operation of the image forming apparatus 100 by executing programs stored in the ROM 201*c* using the RAM 201*b* as a work area. The RAM 201*b* stores, for example, a high voltage set value and the like to the high voltage control part 205. The RAM 201*b* is configured to store data therein even a power of the image forming apparatus 100 is OFF by an auxiliary power supply and the like (not shown). It is noted that the control unit 200 may comprise a RAM used as a work area separately from the RAM 201*b*.

The control unit 200 comprises an A/D converter 203, a high voltage control part 205, a motor control part 207, a DC load control part 208, a sensor interface (I/F) 209, an AC driver 210, and an image control part 220.

The control unit 200 receives a detection result by the sensors 214 by the sensor I/F 209. Based on the detection result of the sensors 214, the CPU 201*a* controls each motor 212 by the motor control part 207. Based on the detection result of the sensors 214, the CPU 201*a* controls the operation of the clutch/solenoid 213 by the DC load control part 208. Based on the detection result of the sensors 214, the CPU 201*a* reads the high voltage set value from the RAM 201*b* and inputs the value to the high voltage unit 206 by the high voltage control part 205.

The A/D converter 203 converts a change in a resistance value of the thermistor 204 in accordance with a change in the temperature of the fixing roller 5*a* into a voltage value to input the voltage value to the CPU 201*a* as a digital signal. In accordance with the input digital signal, the CPU 201*a* controls a heating value of the fixing heater 211 by the AC driver 210 to adjust the temperature of the fixing roller 5*a*. The image control part 220 performs predetermined image processing to the image data and causes the image forming unit 10 to perform the image forming processing based on the image data after the image processing.

(Wiring)

Figure 3:
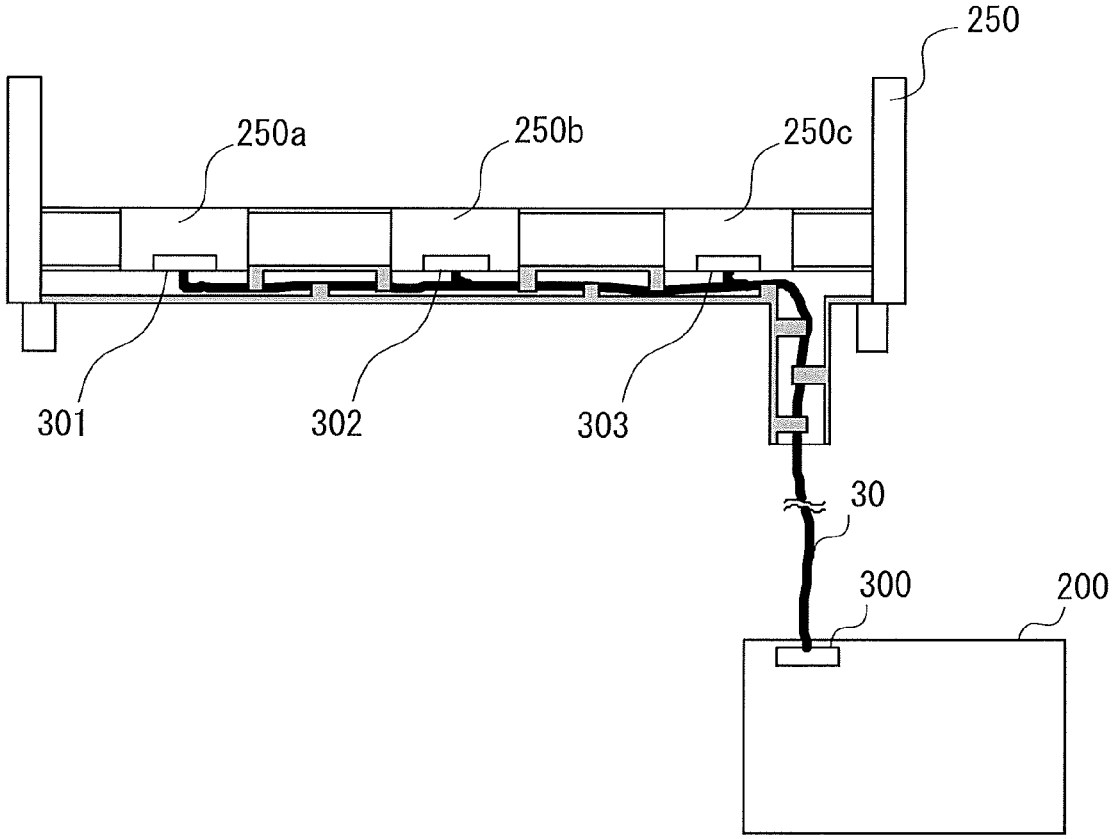
FIG. 3 is an illustration diagram of wiring of the electric wire bundle.

FIG. 3 is an illustration diagram of wiring of the electric wire bundle bundling the plurality of the electric wires which connect the control unit 200 and the registration patch sensor unit 250. The registration patch sensor unit 250 comprises three registration patch sensors (a first patch sensor 250*a*, a second registration patch sensor 250*b*, a third registration patch sensor 250*c*). The registration patch sensor unit 250 is connected to the control unit 200 by an electric wire bundle 30. The electric wire bundle 30 comprises four connectors 300, 301, 302, and 303. The connectors 300, 301, 302, and 303 are connectable to corresponding parts. The connector 300 is connected to the control unit 200. The connector 301 is connected to the first registration patch sensor 250*a*. The connector 302 is connected to the second registration patch sensor 250*b*. The connector 303 is connected to the third registration patch sensor 250*c*. It is noted that the illustration is omitted though, the control unit 200 and the first registration patch sensor 250*a*, the second registration patch sensor 250*b*, and the third registration patch sensor 250*c* respectively comprise connecting parts to which the connectors 300, 301, 302, and 303 are connected.

The control unit 200 is arranged at a back side in the housing of the image forming apparatus 100. The registration patch sensor 250*c* is arranged at an innermost side of the image forming apparatus 100. The registration patch sensor 250*a* is arranged at a frontmost side of the image forming apparatus 100. Because of such arrangement, the electric wire bundle 30 is laid from the innermost side to the frontmost side of the image forming apparatus 100. As a space in the housing of the image forming apparatus 100 occupied by the registration patch sensor unit 250 is limited, a space for wiring the electric wire bundle 30 inevitably becomes narrow. Thereby, when the electric wire which is branched from the electric wire bundle 30 is loosened, the electric wire may be disconnected due to interference with other parts.

Figure 4:
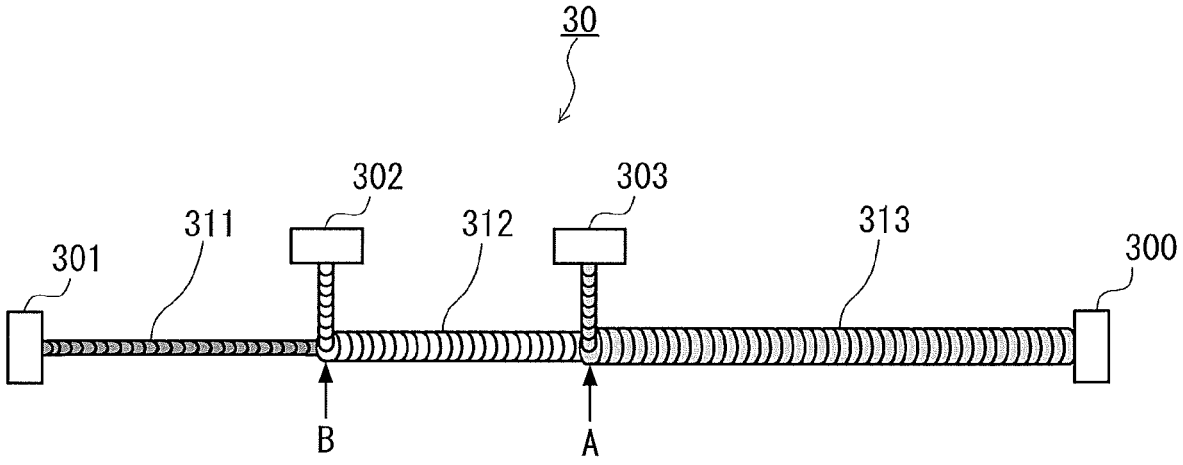
FIG. 4 is an explanatory diagram of the electric wire bundle.

FIG. 4 is an explanatory diagram of the electric wire bundle 30. The electric wire bundle 30 of the present embodiment consists of three electric wires 311, 312, and 313. The electric wire 311 connects between the connector 300 and the connector 301 to connect the control unit 200 and the first registration patch sensor 250*a*. The electric wire 312 connects between the connector 300 and the connector 302 to connect the control unit 200 and the second registration patch sensor 250*b*. The electric wire 313 connects between the connector 300 and the connector 303 to connect the control unit 200 and the third registration patch sensor 250*c*.

The connector 303 is connected to the electric wire 313 which is branched at a branch point A closest to the connector 300 as a reference position. The connector 302 is connected to the electric wire 312 which is branched at a branch point B second closest to the connector 300 as the reference position. The connector 301, provided at a second position which is the farthest position from the connector 300 as the reference position, is connected to the electric wire 311. It is noted that, in the present embodiment, the connector 300 is a first connector arranged at a first position. The connector 301 is a second connector arranged at a second position farthest from the first position. The connectors 302 and 303 are third connectors arranged at a third position closer to the second position. The connectors 302 and 303 are respectively connected to the electric wires 312 and 313, branched at the branch point B and the branch point A respectively positioned between the reference position and the second position. It is noted that, as long as the branch points A and B are positioned between the reference position and the second position, the connectors 302 and 303 may be arranged at a position farther from the connector 300 than the connector 301.

To form the electric wire bundle 30, the electric wire 313 which branches at a position closest to the connector 300 as the reference position winds the other electric wires 311 and 312. The electric wire 313 winds all the other electric wires 311 and 312 to the branch point A, branches at the branch point A, and is connected to the third registration patch sensor 250*c* through the connector 303. It means that the electric wire 313 winds the other electric wires 311 and 312 from the reference position to the branch point A closest to the reference position. At the branch point A, the electric wire 313 is branched, twisted to the connector 303 and connected to the third registration patch sensor 250*c*.

The electric wire bundle 30 ahead of the branch point A when viewed from the connector 300 as the reference position consists of the electric wires 311 and 312. To form the electric wire bundle 30, the electric wire 312 which branches at the position second closest to the connector 300 as the reference position winds the other electric wire 311 excluding the electric wire 313 already branched. The electric wire 312 winds the other electric wire 311 from the branch point A to the branch point B, branches at the branch point B, and is connected to the second registration patch sensor 250*b* through the connector 302. It means that the electric wire 312 winds the other electric wire 311 from the branch point A to the branch point B second closest to the reference position. At the branch point B, the electric wire 312 is branched, twisted to the connector 302 and is connected to the second registration patch sensor 250*b*.

The electric wire bundle 30 ahead of the branch point B when viewed from the connector 300 as the reference position consists of the electric wire 311. As the electric wire bundle 30 consists of one electric wire 311, the electric wire 311 winds no other electric wire. The electric wire 311 branches from the electric wire 312 at the branch point B and is connected to the first registration patch sensor 250*a* through the connector 301. It means that the electric wire 311 is branched at the branch point B, twisted to the connector 301 and connected to the first registration patch sensor 250*a*.

As mentioned, the electric wire bundle 30 uses the electric wire (electric wire 313) which branches at a position having the shortest distance from the connector 300 as the reference position at that point (branch point A) to wind and bundle the other electric wires (electric wires 311, 312). Thereby, the electric wire bundle 30 prevents the plurality of the electric wires (electric wires 311, 312, 313) from being loosened and reduces possibility to cause disconnection and the like by the interference with other parts when the electric wires 311, 312, and 313 are loosened. Further, compared to a case where all electric wires are twisted to prevent the plurality of the electric wires (electric wires 311, 312, 312) from being loosened, increase of a length of the electric wire by twisting and winding the electric wire can be restrained. As a result, a total amount of the required electric wire can be suppressed. Further, the electric wire bundle 30 is easy to form the branch by the outside electric wire which is wound.

(Formation of Electric Wire Bundle)

Figure 5A:
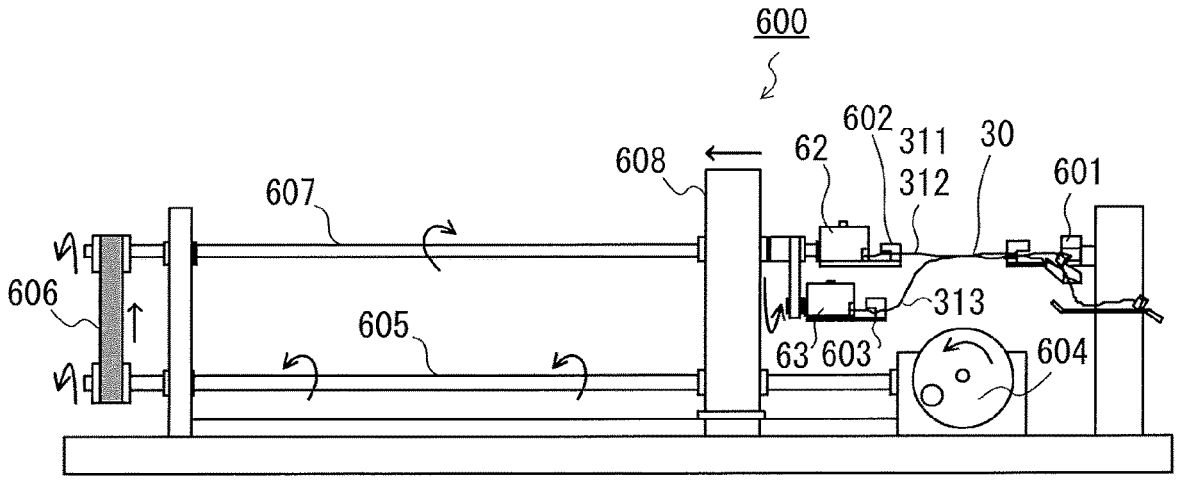
FIG. 5A and FIG. 5B are illustration diagrams of forming devices of the electric wire bundle.
Figure 5B:
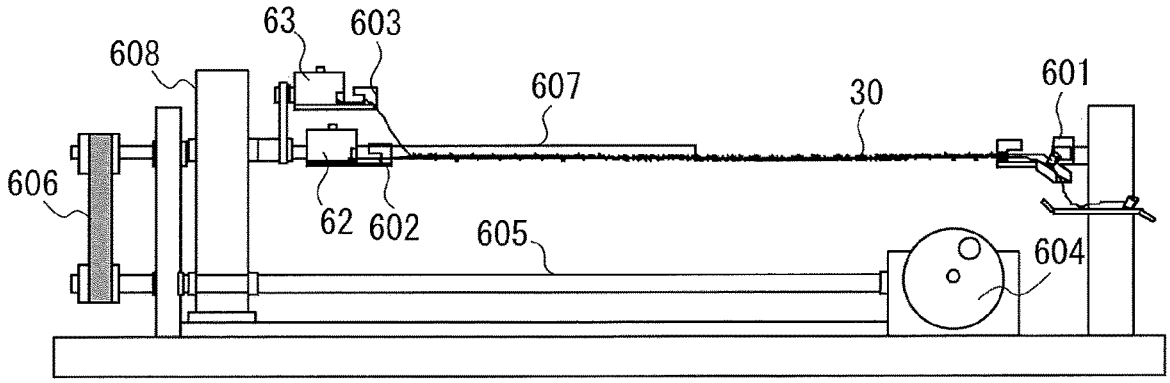

FIG. 5A and FIG. 5B are illustration diagrams of forming devices of the electric wire bundle 30. FIG. 5A shows a state during the winding of the electric wire. FIG. 5B shows a state after the winding of the electric wire. A forming device 600 comprises a fixing part 601, a center side set part 602, a rotation side set part 603, a handle 604, rotation shafts 605, 607, a belt 606, a moving part 608, and storage parts 62 and 63.

When winding the electric wire, the connector 300 as the reference position is attached to the fixing part 601. The fixing part 601 clamps and fixes the plurality of the electric wires 311, 312, and 313 at a position where is desired to start winding. The connectors 301 and 302 are attached to the center side set part 602. The connector 303 which is connected to the electric wire 313 which is branched at the position closest to the connector 300 is attached to the rotation side set part 603. Slack parts of the electric wires 311, 312, and 313 are wound inside the storage parts 62 and 63.

When the handle 604 is rotated in an arrow direction, the rotation shaft 605, the belt 606 and the rotation shaft 607 rotate. By the rotation of the rotation shaft 605, the belt 606 and the rotation shaft 607, the rotation side set part 603 rotates around the center side set part 602. Thus, the electric wire 313 is wound around outside the electric wires 311 and 312. With a simultaneous movement of the moving part 608 to a belt 606 side by a predetermined amount of movement in accordance with a movement of the handle 604, uniform winding is executed. In accordance with a length to wind the electric wire 313 with respect to the electric wires 311 and 312 (a length from the connector 300 to the branch point A), the rotation of the handle 604 is stopped. It is noted that, depending on a type of the electric wire and covering material used, both ends of each of the electric wires 311, 312, and 313 may be bundled by a member such as a banding band to execute the winding.

When the electric wire 312 is wound around the electric wire 313, a position corresponding to the branch point A of the electric wire bundle 30 is clamped and fixed at the fixing part 601. The connector 301 is attached to the center side set part 602. The connector 302 is attached to the rotation side set part 603. When the handle 604 is rotated in this state, the electric wire 312 is wound around outside the electric wire 311.

Twisting of the electric wire 313 from the branch point A to the connector 303 is executed when the position corresponding to the branch point A of the electric wire bundle 30 is fixed at the fixing part 601 and the connector 303 is attached to the rotation side set part 603. Twisting of the electric wire 312 from the branch point B to the connector 302 is executed when a position corresponding to the branch point B of the electric wire bundle 30 is fixed at the fixing part 601 and the connector 302 is attached to the rotation side set part 603.

In the above, simple constitution of the forming device 600 in which the handle 604 is manually rotated is described though, the forming device 600 may be configured to rotate the handle 604 by automatic control by a motor, sensor and a controller.

(Other Example of Electric Wire Bundle)

Figure 6:
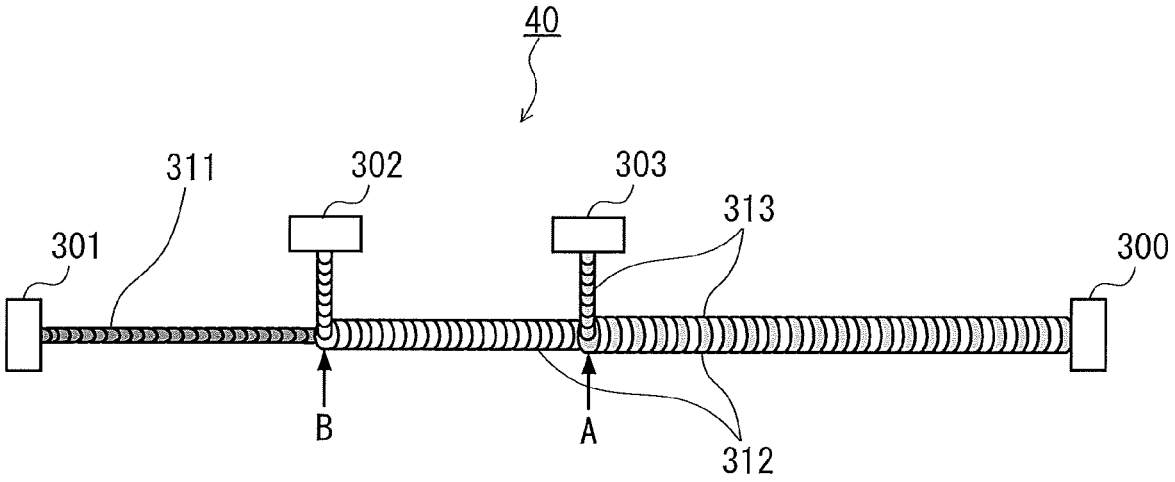
FIG. 6 is an explanatory diagram of the electric wire bundle.

FIG. 6 is an explanatory diagram of an electric wire bundle of other configuration. The functions of the connectors 300 to 303 and the plurality of the electric wires 311 to 313 of the electric wire bundle 40 in FIG. 6 are the same as those of the electric wire bundle 30 in FIG. 4 but the two electric wires differ in terms of how the electric wires 312 and 313 are wound. To form the electric wire bundle 40, the electric wire 311 which is connected to the connector 301 farthest from the connector 300 as the reference position is wound by all the other electric wires 312 and 313.

The electric wire 313 winds the other electric wire 311 with the electric wire 312 from the connector 300 to the branch point A. At the branch point A, the electric wire 313 branches and is connected to the third registration patch sensor 250*c* through the connector 303. It means that the electric wire 313 winds the other electric wire 311 with the electric wire 312 from the reference position to the branch point A closest to the reference position. At the branch point A, the electric wire 313 is branched, twisted to the connector 303, and connected to the third registration patch sensor 250*c*.

The electric wire 312 winds the other electric wire 311 from the connector 300 to the branch point B. At the branch point B, the electric wire 312 branches and is connected to the second registration patch sensor 250*b* through the connector 302. The electric wire 312 winds the electric wire 311 with the electric wire 313 from the connector 300 to the branch point A. It means that the electric wire 312 winds the other electric wire 311 from the reference position to the branch point B second closest to the reference position. At the branch point B, the electric wire 312 is branched, twisted to the connector 302, and connected to the second registration patch sensor 250*b*.

As mentioned, the electric wire bundle 40 uses the electric wires 313 and 312 which branch in order between the connector 300 and the connector 301 which is positioned farthest from the connector 300 to wind and bundle the electric wire 311 in order. Thereby, the electric wire bundle 40 prevents the plurality of the electric wires (electric wires 311, 312, 313) from being loosened and reduces possibility to cause disconnection and the like by the interference with other parts when the electric wires 311, 312 and 313 are loosened. Further, compared to a case where all electric wires are twisted to prevent the plurality of the electric wires (electric wires 311, 312, 313) from being loosened, increase of a length of the electric wire caused by twisting and winding the electric wire can be restrained. As a result, a total amount of the required electric wire can be suppressed. Further, the electric wire bundle 40 is easy to form the branch by the outside electric wire which is wound.

As mentioned, in the electric wire bundles 30 and 40, the plurality of the electric wires 313, 312, and 311 branch in order between the connector 300 as the reference position and the connector 301 which is arranged at the farthest position from the connector 300. The plurality of the electric wires 311, 312, and 313 branched are respectively connected to the corresponding connectors 301, 302, and 303. The electric wire which branches earlier winds and bundles the other electric wire. In case of the electric wire bundle 30, the electric wire which branches earlier winds and bundles all the other electric wires. In case of the electric wire bundle 40, the electric wire which branches earlier winds and bundles the electric wire 311 which is connected to the connector 301 arranged at the farthest position which remains to the end. As the other electric wire is wound by the electric wire which branches earlier, the plurality of the electric wires are bundled without using the wire bundling tool.

The electric wire bundles 30 and 40 can be used for the wiring of various components in the housing of the image forming apparatus 100. For example, the electric wire bundles 30 and 40 can be used for the wiring of the control unit 200 with the high voltage unit 206, each motor 212, and the clutch/solenoid 213. Further, besides the image forming apparatus 100, the electric wire bundles 30 and 40 can be applicable to internal wiring of an electric component such as various electric apparatuses, automobiles and the like. It is noted that, in a case where the connectors 300 to 303 respectively comprise a plurality of terminals, each of the electric wires 311 to 313 consists of the number of the electric wires in accordance with the number of the terminals. In such a case, each of the electric wires 311 to 313 may be configured as the electric wire bundle and the same configuration as the electric wire bundles 30 and 40 may be applied. For example, the electric wires 311 to 313 are wire material used as a communication line for transmitting signals, a power line for supplying electric power and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-052268, filed Mar. 17, 2017 which is hereby incorporated by reference herein in its entirety.

What is claimed is:

1. An image forming apparatus comprising:

an image forming unit configured to form an image on a recording material, wherein the image forming unit includes:

an intermediate transfer belt to which an image formed on a photosensitive drum is transferred; and a secondary transfer part configured to transfer the image transferred to the intermediate transfer belt to a recording material that is conveyed, along a conveyance path, to the secondary transfer part;

a control unit configured to control the image forming unit;

a first component communicating with the control unit, the first component being configured to read an image transferred to the intermediate transfer belt;

a second component communicating with the control unit, the second component being configured to read an image transferred to the intermediate transfer belt;

a third component communicating with the control unit, the third component configured to read an image transferred to the intermediate transfer belt; and an electric wire bundle comprising a plurality of electric wires, wherein the electric wire bundle comprises:

a first electric wire configured to connect the control unit and the first component;

a second electric wire configured to branch from the electric wire bundle at a first branch point provided between the control unit and the first component and to connect the control unit and the second component; and a third electric wire configured to branch from the electric wire bundle at a second branch point provided between the control unit and the second component and to connect the control unit and the third component, wherein the first electric wire is wound by the second electric wire between the first branch point and the second branch point, and the first electric wire is wound by the second electric wire with a gap between each wrap of the second electric wire, with the third electric wire being wound in the gaps between wraps of the second electric wire, wherein a distance between the control unit and the second component is shorter than a distance between the control unit and the first component, and wherein a distance between the control unit and the third component is shorter than a distance between the control unit and the second component.

2. The image forming apparatus according to claim 1, wherein the electric wire bundle includes a power line for supplying electric power to the first component, the second component, and the third component.

3. The image forming apparatus according to claim 1, wherein the third electric wire is configured to wind and bundle only the first electric wire.

4. The image forming apparatus according to claim 1, wherein, after the second electric wire is branched, the third electric wire is configured to wind and bundle all other electric wires except the second electric wire.

5. The image forming apparatus according to claim 1, wherein the first component is a sensor, the second component is a sensor, and the third component is a sensor.

* * * * *